US009193552B2

(12) United States Patent
Hitz

(10) Patent No.: US 9,193,552 B2
(45) Date of Patent: Nov. 24, 2015

(54) SYNCHRONIZED MEDIA HANGER/GUIDE

(71) Applicant: DATAMAX-O'NEIL CORPORATION, Orlando, FL (US)

(72) Inventor: Mark Allen Hitz, Rock Hill, SC (US)

(73) Assignee: Datamax-O'Neil Corporation, Orlando, FL (US)

( * ) Notice: Subject to any disclaimer, the term of this patent is extended or adjusted under 35 U.S.C. 154(b) by 198 days.

(21) Appl. No.: 13/683,177

(22) Filed: Nov. 21, 2012

(65) Prior Publication Data

US 2013/0126664 A1 May 23, 2013

Related U.S. Application Data

(60) Provisional application No. 61/562,643, filed on Nov. 22, 2011.

(51) Int. Cl.

| | |
|---|---|
| ***B65H 75/24*** | (2006.01) |
| ***B65H 16/04*** | (2006.01) |
| ***B65H 16/00*** | (2006.01) |

(52) U.S. Cl.

CPC ..... *B65H 16/04* (2013.01); *B65H 16/005* (2013.01); *B65H 75/241* (2013.01); *B65H 2301/41335* (2013.01); *B65H 2403/41* (2013.01);

(Continued)

(58) Field of Classification Search

CPC .. B65H 16/00; B65H 16/06; B65H 2403/411; B41J 15/042; B41J 15/046; B41J 3/4075; B41J 11/0025; A47K 10/40

USPC ..... 242/578, 578.1, 578.2, 596, 596.1, 242/596.7, 597, 597.5, 597.8, 599, 599.1, 242/599.2; 101/228, 288, 407.1; 400/613, 400/613.1, 619, 693

See application file for complete search history.

(56) References Cited

U.S. PATENT DOCUMENTS 687,443 A * 11/1901 Succie ..... 242/578.1
4,143,977 A 3/1979 Kurihara et al.

(Continued)

FOREIGN PATENT DOCUMENTS

JP 04552558 B2 9/2010

OTHER PUBLICATIONS

Written Opinion of the International Searching Authority, PCT/US2012/036297, Jul. 17, 2012.

(Continued)

*Primary Examiner* — William A Rivera

(74) *Attorney, Agent, or Firm* — Carter, DeLuca, Farrell & Schmidt, LLP

(57) ABSTRACT

A media hanger/guide comprising a media hub having a top surface and a channel extending through a portion of the top surface. The media hanger/guide further comprises two mounting brackets positioned in the channel, each mounting bracket having an elongated member and each elongated member having a plurality of teeth located thereon. Each mounting bracket also has a support member connected thereto. At least a portion of each support member is located outside of the channel of the media hub. The support members are adapted for lateral movement along the channel of the media hub relative to the top surface of the media hub. The media hanger/guide further comprises two gears positioned in the channel. Each gear is in operable connection with the teeth of one of the mounting bracket's elongated members. The gears are also in operable connection with each other.

20 Claims, 5 Drawing Sheets

(52) U.S. Cl.
CPC ..... *B65H2511/51* (2013.01); *B65H 2511/515* (2013.01); *B65H 2801/12* (2013.01)

(56) References Cited

U.S. PATENT DOCUMENTS

| | | | | |
|---|---|---|---|---|
| 4,177,731 | A | | 12/1979 | Kleist et al. |
| 4,788,558 | A | | 11/1988 | Caldwell et al. |
| 4,788,559 | A | | 11/1988 | Ende |
| 4,872,659 | A | | 10/1989 | Kato et al. |
| 4,924,240 | A | | 5/1990 | Herbert et al. |
| 4,991,846 | A | | 2/1991 | Sondej |
| 5,028,155 | A | | 7/1991 | Sugiura et al. |
| 5,087,137 | A | | 2/1992 | Burnard et al. |
| 5,206,662 | A | | 4/1993 | Fox et al. |
| 5,326,182 | A | | 7/1994 | Hagstrom |
| 5,397,192 | A | | 3/1995 | Khormaee |
| 5,468,076 | A | | 11/1995 | Hirano et al. |
| 5,490,638 | A | | 2/1996 | Driftmyer et al. |
| 5,564,841 | A | | 10/1996 | Austin et al. |
| 5,600,350 | A | | 2/1997 | Cobbs et al. |
| 5,650,730 | A | | 7/1997 | Herbst, Jr. |
| 5,684,516 | A | | 11/1997 | Cseledy et al. |
| 5,790,162 | A | | 8/1998 | Adams et al. |
| 5,813,343 | A | * | 9/1998 | Harb ..... 101/407.1 |
| 5,820,280 | A | | 10/1998 | Fox |
| 5,836,704 | A | | 11/1998 | Lau et al. |
| 5,870,114 | A | | 2/1999 | Numata et al. |
| 5,872,585 | A | | 2/1999 | Donato et al. |
| 5,874,980 | A | | 2/1999 | West |
| 5,909,233 | A | | 6/1999 | Hamman et al. |
| 5,927,875 | A | | 7/1999 | Lau et al. |
| 5,978,004 | A | | 11/1999 | Ehrhardt |
| 5,995,128 | A | | 11/1999 | Adams et al. |
| 6,014,229 | A | | 1/2000 | Yun |
| 6,020,906 | A | | 2/2000 | Adams et al. |
| 6,034,708 | A | | 3/2000 | Adams et al. |
| 6,057,870 | A | | 5/2000 | Monnier et al. |
| 6,070,048 | A | | 5/2000 | Nonaka et al. |
| 6,082,914 | A | | 7/2000 | Barrus et al. |
| 6,095,704 | A | | 8/2000 | Jaeger et al. |
| 6,099,178 | A | | 8/2000 | Spurr et al. |
| 6,129,463 | A | | 10/2000 | Lau et al. |
| 6,201,255 | B1 | | 3/2001 | Torchalski et al. |
| 6,283,024 | B1 | | 9/2001 | George |
| 6,289,730 | B1 | | 9/2001 | Elgee |
| 6,302,604 | B1 | | 10/2001 | Bryant et al. |
| 6,389,241 | B1 | | 5/2002 | Cernusak et al. |
| 6,396,070 | B1 | | 5/2002 | Christensen et al. |
| 6,520,614 | B2 | | 2/2003 | Kaneko |
| 6,616,362 | B2 | | 9/2003 | Bouverie et al. |
| 6,825,864 | B2 | | 11/2004 | Botten et al. |
| 6,840,689 | B2 | | 1/2005 | Barrus et al. |
| 6,846,121 | B2 | | 1/2005 | Bouverie et al. |
| 6,857,714 | B2 | | 2/2005 | Hoberger et al. |
| 6,900,449 | B2 | | 5/2005 | Bolash et al. |
| 6,942,403 | B2 | | 9/2005 | Hohberger et al. |
| 7,042,478 | B2 | | 5/2006 | Bouverie et al. |
| 7,071,961 | B2 | | 7/2006 | Ullenius et al. |
| 7,079,168 | B2 | | 7/2006 | Ullenius et al. |
| 7,150,572 | B2 | | 12/2006 | McNestry et al. |
| 7,162,460 | B2 | | 1/2007 | Cleckler et al. |
| 7,205,561 | B2 | | 4/2007 | Chelvayohan et al. |
| 7,255,343 | B2 | | 8/2007 | So |
| 7,375,832 | B2 | | 5/2008 | Bouverie et al. |
| 7,456,995 | B2 | | 11/2008 | Stephens |
| 7,502,042 | B2 | | 3/2009 | Hitz et al. |
| 7,537,404 | B2 | | 5/2009 | Bouverie et al. |
| 7,600,684 | B2 | | 10/2009 | Tobin et al. |
| 7,667,874 | B2 | | 2/2010 | MacDonald et al. |
| 7,699,550 | B2 | | 4/2010 | Bouverie et al. |
| 7,824,116 | B2 | | 11/2010 | Lyman |
| 7,845,632 | B2 | | 12/2010 | Windsor et al. |
| 7,857,414 | B2 | | 12/2010 | Eun et al. |
| 7,876,223 | B2 | | 1/2011 | Yamaguchi et al. |
| 7,891,892 | B2 | | 2/2011 | Chiu |
| 7,907,159 | B2 | | 3/2011 | Matsuo et al. |
| 7,934,881 | B2 | | 5/2011 | Lodwig et al. |
| 7,938,501 | B2 | | 5/2011 | Takamiya et al. |
| 8,142,087 | B2 | | 3/2012 | Kugimachi |
| 2001/0008612 | A1 | | 7/2001 | Liljestrand et al. |
| 2003/0081024 | A1 | | 5/2003 | Vives et al. |
| 2003/0141655 | A1 | | 7/2003 | Bryer |
| 2004/0008365 | A1 | | 1/2004 | Hobbs |
| 2004/0114024 | A1 | | 6/2004 | Bouverie et al. |
| 2004/0165927 | A1 | | 8/2004 | Fisher et al. |
| 2005/0002715 | A1 | | 1/2005 | Fries et al. |
| 2005/0189693 | A1 | | 9/2005 | Ko |
| 2005/0190368 | A1 | | 9/2005 | Ehrhardt, Jr. et al. |
| 2005/0204940 | A1 | | 9/2005 | Elliott et al. |
| 2006/0007295 | A1 | | 1/2006 | Ueda |
| 2006/0045601 | A1 | | 3/2006 | Endo |
| 2006/0055721 | A1 | | 3/2006 | Burdette et al. |
| 2006/0157911 | A1 | | 7/2006 | Learmonth et al. |
| 2006/0159504 | A1 | | 7/2006 | Blanchard, Jr. et al. |
| 2006/0180737 | A1 | | 8/2006 | Consiglio |
| 2007/0022233 | A1 | | 1/2007 | Bridges et al. |
| 2007/0040326 | A1 | | 2/2007 | Noda et al. |
| 2007/0059078 | A1 | | 3/2007 | Silverbrook et al. |
| 2007/0138738 | A1 | | 6/2007 | Motohashi et al. |
| 2009/0038495 | A1 | | 2/2009 | Butzen et al. |
| 2009/0103806 | A1 | | 4/2009 | Nakami |
| 2009/0244584 | A1 | | 10/2009 | McGarry et al. |
| 2010/0066782 | A1 | | 3/2010 | Yamamoto et al. |
| 2010/0147990 | A1 | * | 6/2010 | McLawhorn ..... 242/532.6 |
| 2010/0169513 | A1 | | 7/2010 | Levin |
| 2010/0247222 | A1 | | 9/2010 | Bouverie et al. |
| 2010/0319561 | A1 | | 12/2010 | Colquitt et al. |
| 2011/0042883 | A1 | | 2/2011 | Wang et al. |
| 2011/0132643 | A1 | | 6/2011 | Hattori et al. |

OTHER PUBLICATIONS

Written Opinion of the International Searching Authority, PCT/US2012/039043, Aug. 3, 2012.
Written Opinion of the International Searching Authority, PCT/US2012/041093, Aug. 7, 2012.
Written Opinion of the International Searching Authority, PCT/US2012/043734, Sep. 21, 2012.
Written Opinion of the International Searching Authority, PCT/US2012/043709, Sep. 21, 2012.
Written Opinion of the International Searching Authority, PCT/US2012/043772, Sep. 14, 2012.
Written Opinion of the International Searching Authority, PCT/US2012/046712, Oct. 5, 2012.
Written Opinion of the International Searching Authority, PCT/US2012/049417, Nov. 2, 2012.
Written Opinion of the International Searching Authority, PCT/US2012/050938, Nov. 6, 2012.
Written Opinion of the International Searching Authority, PCT/US2012/060956, Jan. 11, 2013.
Written Opinion of the International Searching Authority, PCT/US2012/066291, Feb. 5, 2013.

* cited by examiner

SYNCHRONIZED MEDIA HANGER/GUIDE

CROSS-REFERENCE TO RELATED APPLICATION(S)

This application claims priority to provisional patent application No. 61/562,643 filed Nov. 22, 2011, entitled "Synchronized Media Hanger/Guide", the contents of which are herein incorporated by reference.

FIELD OF DISCLOSURE

The present invention relates generally to media hangers utilized in copiers and printers; more specifically, to a media hanger/guide with synchronized support members that hold media therebetween, one of which is foldable to allow insertion of new media without displacing the support member's position.

BACKGROUND

Printing systems such as copiers, printers, facsimile devices or other systems having a print engine for creating visual images, graphics, texts, etc. on a page or other printable medium typically include various media feeding systems for introducing original image media or printable media into the system. Examples include direct thermal and thermal transfer demand printers. Typically, a thermal transfer printer is a printer which prints on media by melting a coating of ribbon so that it stays affixed to the media on which the print is applied. It contrasts with direct thermal printing where no ribbon is present in the process and an image is created by application of heat to a temperature sensitive media. Typically, thermal transfer printers comprise at least one supply spindle operable for supplying a media web and ribbon, a print station, and a take up spindle. New ribbon and media is fed from the supply spindle along a predetermined media feed path to the print station for printing and then the ribbon is wound up by the take up spindle while the media exits the print station.

Problems with current printing systems include alignment and compression issues along the media feed path, which may result in faulty or defective printing. Media hangers and/or guides, also referred to as media storage assemblies, are utilized in such printers and associated devices so as to retain a supply of media and ribbon and initially guide the media through the predetermined media feed path of the printer. Heretofore, the type of media hanger utilized in printers has been dependent upon the type and size of media utilized. This dependency severely limits the anticipated use of the media hanger, and the printer, to only one media type and size. Undesirably, the lack of versatility and configurability in accommodating varying media types and sizes causes a need for separate printers and media guides to be purchased if printing on various types and sizes media is desired. Additionally, conventional media hangers require the manual movement or manipulation of one support member at a time in order to position a media supply media on or about an assembly. However, such movement may result in the media being off center relative to the media feed path.

SUMMARY OF THE INVENTION

In accordance with the teachings disclosed herein, embodiments related to a media hanger/guide are disclosed. Embodiments of the present invention provide a configurable and adaptable media hanger/guide operable for use within a printing system that may be used in conjunction with a variety of media types and sizes. Embodiments of the present invention maintain media positioned thereon in a centered position relative to the media feed path by providing synchronized movement of support members located on both sides of the media in either an expansive or compressive manner. Embodiments of the present invention also provide an integral media sensor configured to detect media level or media presence such that an alert to a user may be triggered or displayed.

In an exemplary embodiment, the media hanger/guide includes a media hub having a top surface and a channel extending through a portion of the top surface. The media hanger/guide further includes two mounting brackets, each having an elongated member and each elongated member having a plurality of teeth located thereon. The mounting brackets can be positioned in the channel. Each mounting bracket includes a support member connected thereto. At least a portion of each support member is preferably located outside of the channel of the media hub. The support members can be adapted for lateral movement along the channel of the media hub relative to the top surface of the media hub. The media hanger/guide further includes two gears positioned in the channel. The first gear is preferably in operable connection with the teeth of one of the mounting bracket's elongated members. The second gear is preferably in operable connection with the teeth of the other mounting bracket's elongated members. The gears can also be in operable connection with each other.

In an additional exemplary embodiment, the media hanger/guide further includes a lock movably secured to the media hub. The lock is preferably movable between a first position and a second position. The first position of the lock preferably engages the second mounting bracket and thereby secures the first support member and the second support member in a predetermined position. The second position can disengage the second mounting bracket and thereby allow lateral movement of the first support member and the second support member along the media hub relative to the media hub's top surface.

In another exemplary embodiment, the media hanger/guide further includes a mounting bracket cover positioned within the channel of the media hub. The mounting bracket cover can partially enclose the mounting brackets and the gears within the media hub. The mounting bracket can have elongated apertures positioned to allow lateral movement of the support members.

In another exemplary embodiment, the first support member is allowed to move between a position near a first end of the media hub and a position near the lengthwise-center of the media hub. The second support member is allowed to move between a position near a second end of the media hub, located opposite the first end of the media hub, and a position near the lengthwise-center of the media hub. The relative positions near the lengthwise-center of the media hub can be spaced apart.

In an additional exemplary embodiment, the media hanger/guide further includes one or more sensors located on one or both of the support members.

In a further exemplary embodiment, one or both of the support members can be foldable from a first position to a second position in relation to the media hub. The first position can be a position substantially perpendicular to the media hub. The second position can be a position substantially parallel to the media hub.

In a still further exemplary embodiment, the media hanger/guide includes mounting brackets, each having an elongated member wherein each elongated member includes a plurality of teeth located thereon. Each mounting bracket can also have a support member connected thereto. The media hanger/guide can further include two gears. The first gear can be in operable connection with the teeth of one of the mounting bracket's elongated members. The second gear is in operable connection with the teeth of the other mounting bracket's elongated members. The gears are preferably also in operable connection with each other.

In an additional exemplary embodiment, the media hanger/guide further includes one or more sensors located on one or both of the support members.

In a further exemplary embodiment, one or both of the support members can be foldable from a first position to a second position in relation to the mounting brackets. The first position can be a position substantially perpendicular to the mounting brackets. The second position can be a position substantially parallel to the mounting brackets.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof.

BRIEF DESCRIPTION OF THE DRAWINGS

The present subject matter may take form in various components and arrangements of components, and in various steps and arrangements of steps. The appended drawings are only for purposes of illustrating exemplary embodiments and are not to be construed as limiting the subject matter.

DETAILED DESCRIPTION OF THE EMBODIMENTS

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. In certain instances, well-known methods, procedures, components, and circuits have not been described in detail.

Figure 1:
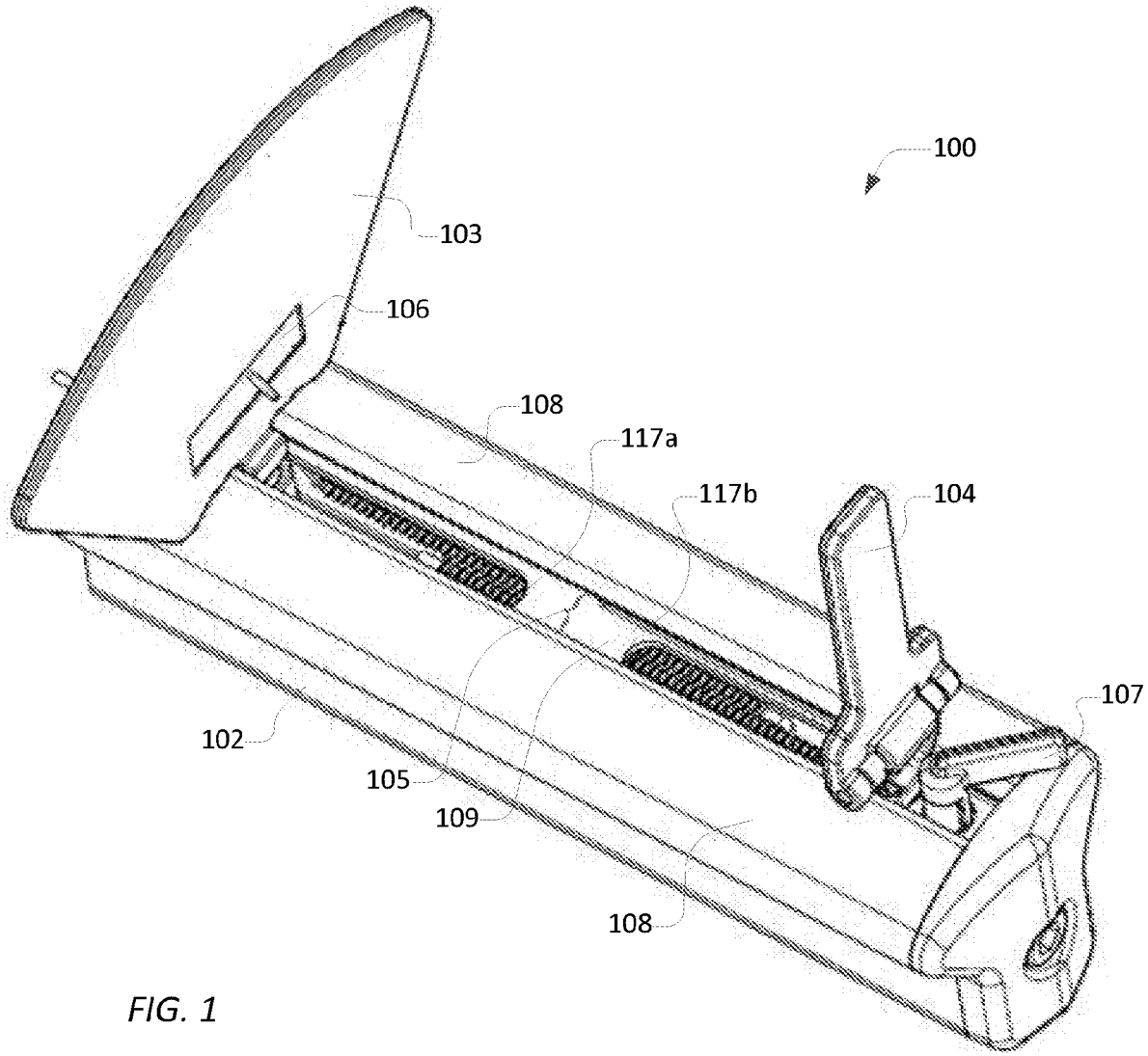
FIG. 1 is a perspective view of a media hanger/guide in an open position in accordance with an exemplary embodiment of the present invention.
Figure 2:
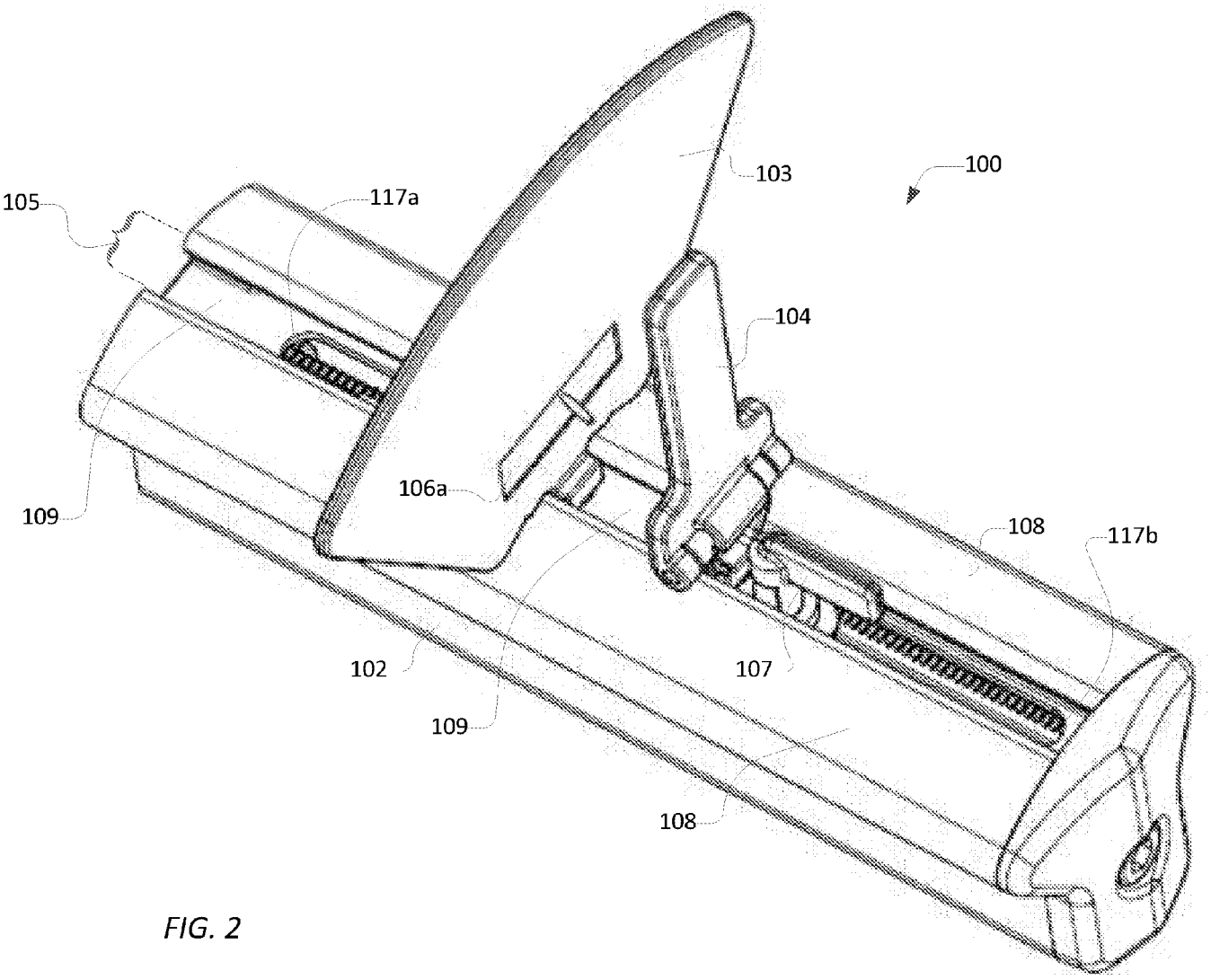
FIG. 2 is a perspective view of a media hanger/guide in a closed position in accordance with an exemplary embodiment of the present invention.

Referring now to the drawings, FIG. 1 illustrates an exemplary embodiment of the present invention in an expanded or open position and FIG. 2 illustrates an exemplary embodiment of the present invention in a compressed or closed position, wherein media may be inserted thereon. As shown, media hanger/guide 100, adapted for use within a printing system (not shown), can include media hub 102. In exemplary embodiments, media hub 102 can be provided with at least one securing screw (not shown) for mounting media hub 102 to the printing system (not shown). Media hanger/guide 100 can further include channel 105 extending along top surface 108 of media hub 102. Mounting bracket cover 109 having apertures 117*a*, 117*b* can be located within channel 105.

Media hanger/guide 100 can further include first support member 103, and second support member 104. Support members 103 and 104 can be adapted for lateral movement along channel 105. Apertures 117*a*, 117*b* can direct lateral movement of first support member 103 and second support member 104.

One or more media sensors 106*a*, 106*b* (see FIG. 4) can be present in media hanger/guide 100. Media sensor(s) 106*a* and/or 106*b* can be provided and located on first support member 103 and/or second support member 104. Media sensors 106*a*, 106*b* can be adapted to detect the presence and/or absence of media in synchronized media hanger/guide 100 and can be in communication with control circuitry (not shown). Media sensors 106*a*, 106*b* can be optical sensors, mechanical sensors, or another suitable sensor as is known in the art. The presence or absence of media, as determined by media sensors 106*a*, 106*b*, may influence certain functions of the print system (not shown) printer according to programming within the control circuitry (not shown). Media sensors 106*a*, 106*b* can be used with roll media, although use of the sensors in conjunction with folded media or other types of media is also contemplated.

According to aspects of the present invention, at least one optional lock 107 can be movably secured to media hub 102 for locking first support member 103 and/or second support member 104 in a predetermined position along channel 105 of media hub 102. In an exemplary embodiment, lock 107 can be a cam locking handle; however, although shown in the figures as a locking handle, lock 107 may be of any type of lock capable of maintaining the position of support member 103, 104. Lock 107 can be utilized to hold media hanger/guide 100 in an open position as shown in FIG. 1, in a closed position as shown in FIG. 2, or any position therebetween.

Lock 107 can allow first support member 103 and first support member 104 to be maintained in various positions along channel 105 of media hub 102. Such positioning may be desirable when using fan-fold media. Lock 107 can be rotated between a first position and a second position. Positioning lock 107 in a first position can secure first support member 103 and second support member 104 in predetermined positions and positioning lock 107 in a second position can allow lateral movement of first support member 103 and second support member 104 along channel 105 of media hub 102.

Figure 3:
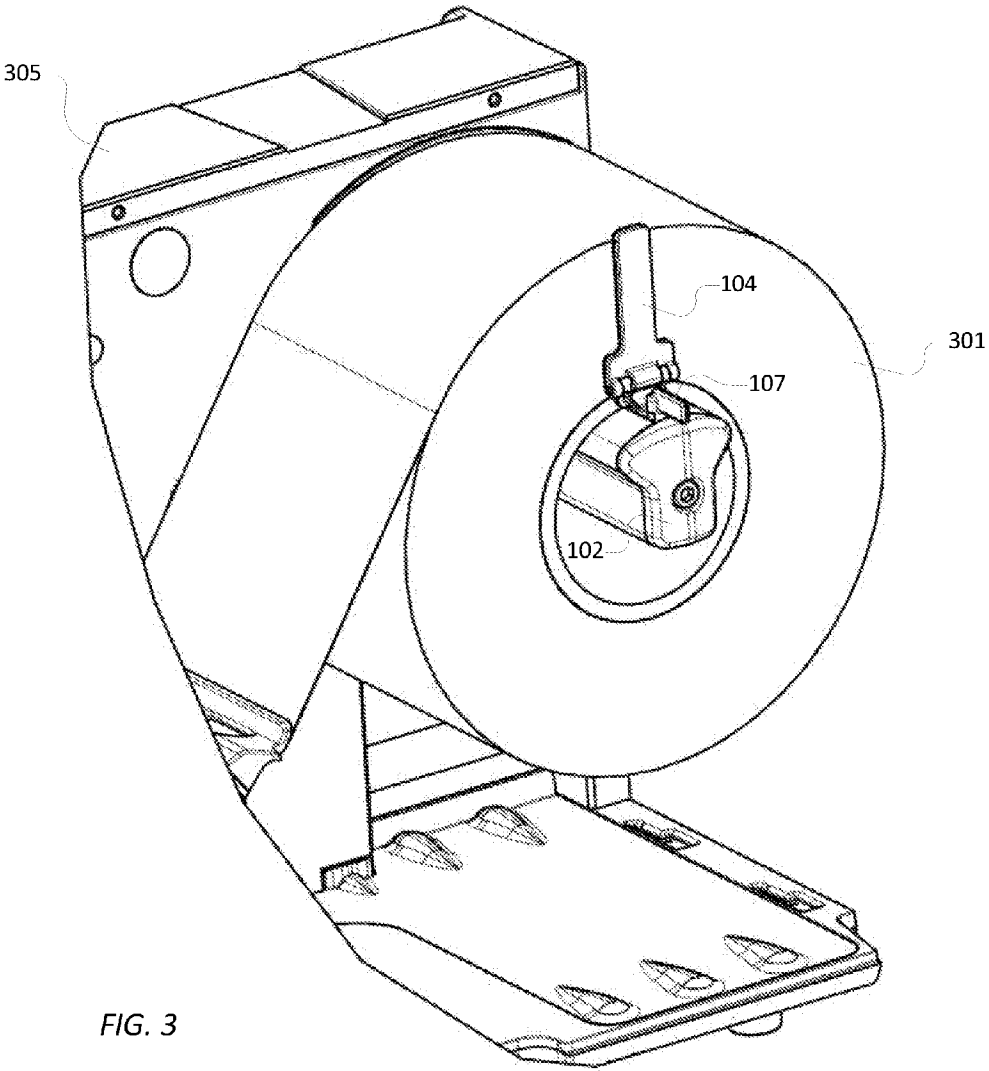
FIG. 3 is a perspective view of a portion of a media hanger/guide installed in a print station with a media roll secured thereon in accordance with an exemplary embodiment of the present invention.

Referring now to FIG. 3, a perspective view of a portion of an exemplary embodiment of media hanger/guide 100 is shown installed in partially viewable print station 305 with media 301 secured thereon. Media 301 can be positioned on media hub 102 such that media 301 is located between first support member 103 (not shown) and second support member 104. With lock 107 disengaged, the positions of first support member 103 and first support member 104 can be adjusted to the size of media 301. First support member 103 and second support member 104 can be adjusted simultaneously and synchronously so as to center the media within the hanger/guide. Simultaneous and synchronous adjustment will be discussed in further detail below.

Media hanger/guide 100 can be utilized in conjunction with a variety of media types and sizes. Although not shown, embodiments of the present invention can be used to guide and house media of various forms, including, but not limited to, rolled media and fan-fold media.

Figure 4:
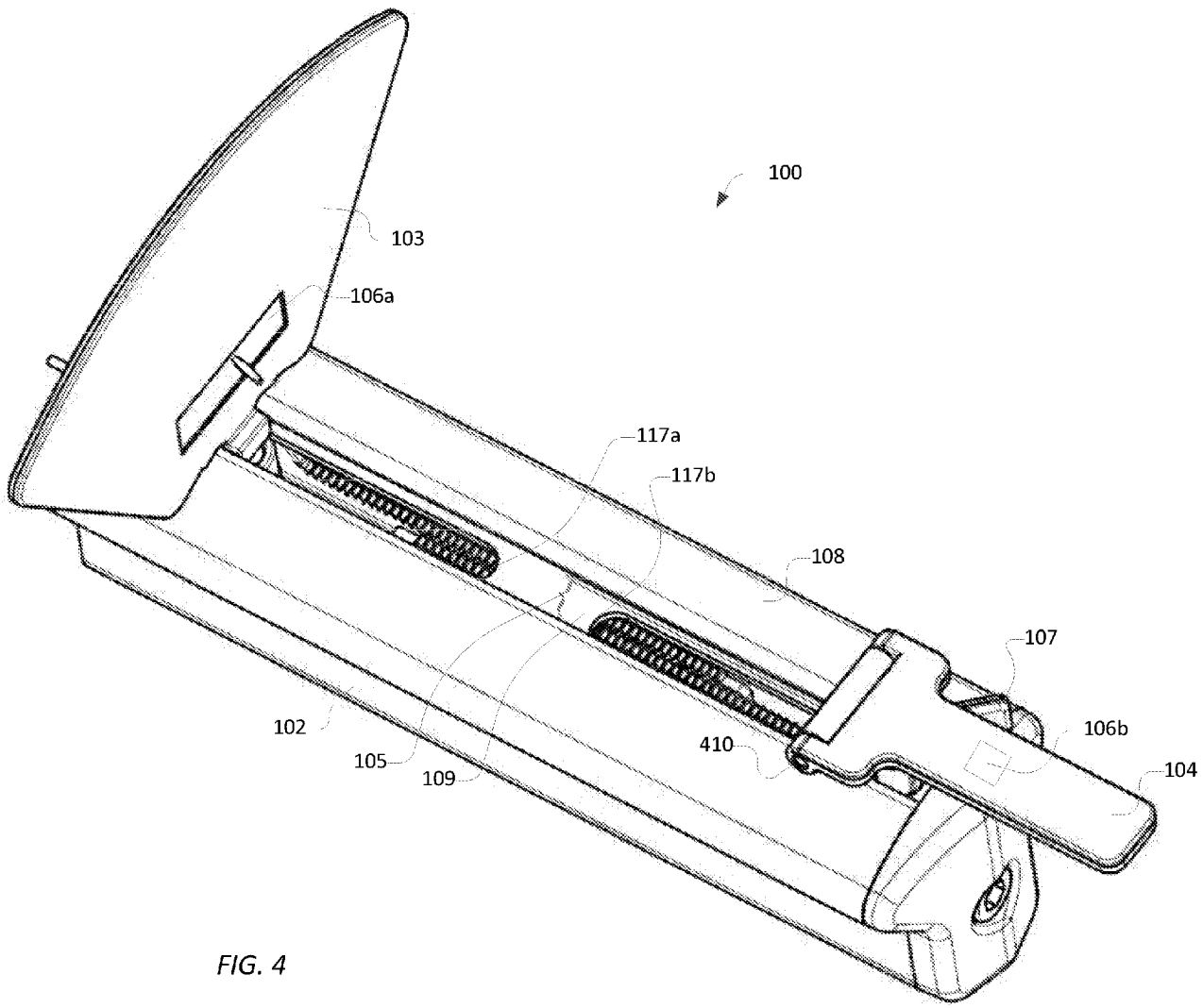
FIG. 4 is a perspective view of a media hanger/guide in a loading position in accordance with an exemplary embodiment of the present invention.

Referring now to FIG. 4, a perspective view of an exemplary embodiment of media hanger/guide 100 is shown in a loading position. Second support member 104 can be foldable about pivot point 410. Although pivot point 410 is illustrated as being located at the base of second support member 104, other locations of pivot point 410 are envisioned. The degree in which second support member 104 folds can vary from zero degree to 360 degrees. Detents (not shown) can be provided to assist in snapping second support member 104 into a position and maintain second support member 104 in such position. Although FIG. 3 depicts second support member 104 as foldable, in addition or in the alternative, first support member 103 can also be foldable.

Providing one or more foldable support members can allow for loading of media having the same size as previously loaded media without having to move the support members. By way of non-limiting example, if first support member 103 and second support member 104 were previously adapted to fit a certain size media, then new media of the same size can be loaded without linear movement of the support members along channel 105. If pivot point 410 is located at the base of second support member 104 and if second support member 104 is foldable by approximately ninety degrees from a substantially vertical start position, the new media roll can be loaded onto media hub 102.

Figure 5:
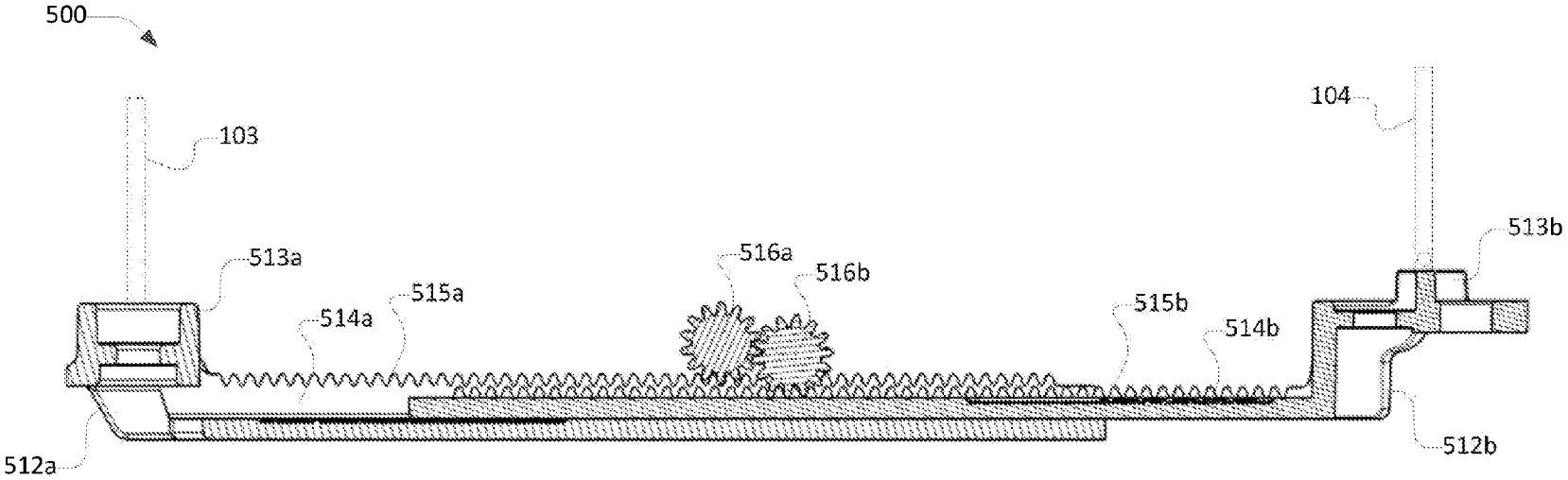
FIG. 5 is a cross-sectional view of support member mounting brackets of a media hanger/guide in accordance with an exemplary embodiment of the present invention.

Now referring to FIG. 5, a cross-sectional view of an exemplary embodiment of support member mounting brackets of media hanger/guide 100 is shown. First support member 103 and second support member 104 can be secured to, inserted into, connectable to, or otherwise attached to first mounting bracket 512*a* and second mounting bracket 512*b*, respectively. First mounting bracket 512*a* and second mounting bracket 512*b* can be sized and shaped so as to permit first support member 103 and second support member 104, respectively, to movably slide along apertures 117*a*, 117*b* when lock 107 is disengaged and directional pressure is applied to either support member. Movement of first mounting bracket 512*a* and second mounting bracket 512*b* can be synchronized with one another via varying means, including, but not limited to, a rack and dual pinion system or other centering system as is known in the art.

In an exemplary embodiment, first mounting bracket 512*a* and second mounting bracket 512*b* are synchronized utilizing a rack and pinion system 500. First mounting bracket 512*a* can comprise first mount 513*a* and first elongated member 514*a* having plurality of teeth 515*a* thereon. Similarly, second mounting bracket 512*b* can comprise second mount 513*b* and second elongated member 514*b* having a plurality of teeth 515*b* thereon.

First gear 516*a* and second gear 516*b* can engage teeth 515*a* and teeth 515*b*, respectively, such that when rotational motion is applied to gear first gear 516*a* and second gear 516*b*, first elongated member 514*a* and second elongated member 514*b* move. First gear 516*a* and second gear 516*b* can be positioned such that they can engage one another. In such a manner, when one of first support member 103 or first support member 104 is adjusted, a rotational motion is initially applied to the respective first gear 516*a* or second gear 516*b*, causing rotational movement of the respective opposite gear 516*b* or 516*a* and movement of both first elongated member 514*a* and second elongated member 514*b* occurs. Adjustment of first support member 103 and second support member 104 can be manual and/or automatic.

First mount 513*a* and second mount 513*b* can be used for connecting first support member 103 and second support member 104, respectively, thereto. This support member mounting bracket system can allow simultaneous and synchronous adjustment of first support member 103 and second support member 104. For example, when one support member is adjusted, the other support member is oppositely adjusted in a simultaneous manner.

The following is an exemplary use of an embodiment of synchronized media hanger/guide 100. If second support member 104 is in an upright position, second support member 104 can be folded such that it is substantially parallel to media hub 102. Media roll 301 (or any other type of media) can be loaded on media hub 102. Once media roll 301 is loaded, second support member 104 can be positioned such that it is substantially perpendicular to media hub 102. First support member 103 and second support member 104 can be manipulated so as to move first support member 103 and second support member 104 toward or away from one another along media hub 102 to a desired position. Channel 105 and apertures 117 can provide guidance and/or structural support for the movement of first support member 103 and second support member 104 along media hub 102. Simultaneous and synchronized movement can allow for media 301 to be centered within media guide/hanger 100. Lock 107 may be rotated to lock first support member 103 and second support member 104 into position.

Having now described the invention, the construction, the operation and use of exemplary embodiments thereof, and the advantageous new and useful results obtained thereby, the new and useful constructions, and reasonable mechanical equivalents thereof obvious to those skilled in the art, are set forth in the appended claims.

What is claimed is:

1. A media hanger/guide comprising:

a media hub having a top surface and a channel extending through a portion of the top surface, the channel extending from a first end of the media hub to a second end of the media hub opposite the first end;

a first mounting bracket positioned in the channel near the first end and having an elongated member, wherein a plurality of teeth are located on the elongated member;

a first support member connected to the first mounting bracket, wherein at least a portion of the first support member is located outside of the channel;

a second mounting bracket positioned in the channel near the second end and having an elongated member, wherein a plurality of teeth are located on the elongated member;

a second support member connected to the second mounting bracket, wherein at least a portion of the second support member is located outside of the channel and wherein the first support member and the second support member are adapted for lateral movement along the channel of the media hub relative to the top surface of the media hub;

a first gear positioned in the channel and in operable connection with the first mounting bracket's elongated member teeth; and a second gear positioned in the channel and in operable connection to the second mounting bracket's elongated member teeth, wherein the first gear is directly coupled to the second gear.

2. The media hanger/guide of claim 1, further comprising a lock movably secured to the media hub, wherein positioning of the lock in a first position engages the second mounting bracket thereby securing the first support member and the second support member in predetermined positions and positioning of the lock in a second position disengages the second mounting bracket thereby allowing lateral movement of the first support member and the second support member along the media hub relative to the media hub top surface.

3. The media hanger/guide of claim 2, wherein the lateral movement of the first support member and the second support member along the media hub is opposite and complimentary for maintaining the position of a printing media substantially centered on the media hub.

4. The media hanger/guide of claim 1, further comprising at least one sensor located on at least one support member.

5. The media hanger/guide of claim 4, wherein the at least one sensor is selected from the group consisting of: an optical sensor; a mechanical sensor; and an electromechanical sensor.

6. The media/hanger guide of claim 4, wherein the at least one sensor is located on the first support member.

7. The media hanger/guide of claim 1, wherein at least one support member is foldable from a first position to a second position in relation to the media hub.

8. The media hanger/guide of claim 7, wherein the first position of the at least one support member is a position substantially perpendicular to the media hub and wherein the second position of the second member is a position substantially parallel to the media hub.

9. The media hanger/guide of claim 8, wherein the at least one support member is the second support member.

10. The media hanger/guide of claim 1, further comprising a mounting bracket cover having a first aperture and a second aperture and positioned within the channel of the media hub partially enclosing the first mounting bracket, the second mounting bracket, the first gear and the second gear within the media hub and wherein the first aperture is elongated in shape and positioned to allow lateral movement of the first support member and the second support member along the media hub.

11. The media hanger/guide of claim 10, wherein the lateral movement of the first support member and the second support member along the media hub is opposite and complimentary for maintaining the position of a printing media substantially centered on the media hub.

12. A media hanger/guide comprising:

a first mounting bracket having an elongated member, wherein a plurality of teeth are located on the elongated member, the first mounting bracket being disposed near a first end of the media hanger/guide;

a first support member connected to the first mounting bracket;

a second mounting bracket having an elongated member, wherein a plurality of teeth are located on the elongated member, the second mounting bracket being disposed near a second end of the media hanger/guide opposite the first end;

a second support member connected to the second mounting bracket;

a first gear in operable connection to the first mounting bracket's elongated member teeth; and a second gear in operable connection to the second mounting bracket's elongated member teeth, wherein the first gear is directly coupled to the second gear.

13. The media hanger/guide of claim 12, further comprising at least one sensor located on at least one support member.

14. The media hanger/guide of claim 13, wherein the at least one sensor is selected from the group consisting of: an optical sensor; a mechanical sensor; and an electromechanical sensor.

15. The media hanger/guide of claim 12, wherein at least one support member is foldable from a first position to a second position in relation to the media hub.

16. The media hanger/guide of claim 15, wherein the first position of the at least one support member is a position substantially perpendicular to the media hub and wherein the second position of the second member is a position substantially parallel to the media hub.

17. A media hanger/guide comprising:

a media hub having a top surface and a channel extending through a portion of the top surface, the channel extending from a first end of the media hub to a second end of the media hub opposite the first end;

a first mounting bracket positioned in the channel near the first end and having an elongated member, wherein a plurality of teeth are located on the elongated member;

a first support member connected to the first mounting bracket, wherein at least a portion of the first support member is located outside of the channel;

a second mounting bracket positioned in the channel near the second end and having an elongated member, wherein a plurality of teeth are located on the elongated member;

a second support member connected to the second mounting bracket, wherein at least a portion of the second support member is located outside of the channel and wherein the first support member and the second support member are adapted for lateral movement along the channel of the media hub relative to the top surface of the media hub;

a first gear positioned in the channel and in operable connection with the first mounting bracket's elongated member teeth;

a second gear positioned in the channel and in operable connection to the second mounting bracket's elongated member teeth, wherein the first gear is directly coupled to the second gear; and a lock movably secured to the media hub, wherein positioning of the lock in a first position engages the second mounting bracket thereby securing the first support member and the second support member in predetermined positions and positioning of the lock in a second position disengages the second mounting bracket thereby allowing lateral movement of the first support member and the second support member along the media hub relative to the media hub top surface, wherein the lateral movement of the first support member and the second support member along the media hub is opposite and complimentary for maintaining the position of a printing media substantially centered on the media hub.

18. The media hanger/guide of claim 17, further comprising at least one sensor located on at least one support member.

19. The media hanger/guide of claim 18, wherein the at least one sensor is selected from the group consisting of: an optical sensor; a mechanical sensor; and an electromechanical sensor.

20. The media hanger/guide of claim 17, wherein at least one support member is foldable from a first position to a second position in relation to the media hub and wherein the first position of the at least one support member is a position substantially perpendicular to the media hub and wherein the second position of the second member is a position substantially parallel to the media hub.

* * * * *